US005868469A

United States Patent [19]

Ming

[11] Patent Number: 5,868,469

[45] Date of Patent: Feb. 9, 1999

[54] FOLDING CHAIR HAVING A SEAT ADJUSTABLE IN HEIGHT

[76] Inventor: Liao Tsung Ming, 2-8 North South One Road, Tah Cha Township, Taichung Hsien, Taiwan

[21] Appl. No.: 50,271

[22] Filed: Mar. 30, 1998

[51] Int. Cl.[6] ..... A47C 3/20

[52] U.S. Cl. ..... 297/338; 297/16.1; 297/16.2; 297/19; 297/58

[58] Field of Search ..... 297/338, 16.1, 297/16.2, 19, 58; 248/125.1, 245, 246, 295.11; 108/110, 148, 144.11

[56] References Cited

U.S. PATENT DOCUMENTS 4,793,654 12/1988 Takafuji ..... 297/338

5,511,855 4/1996 Miles ..... 297/338 X 5,609,390 3/1997 Takafuji ..... 297/338 X

*Primary Examiner*—Peter M. Cuomo

*Assistant Examiner*—Rodney B. White

*Attorney, Agent, or Firm*—Harrison & Egbert

[57] ABSTRACT

A folding chair is composed of a support frame, two seat support arms fastened with the support frame by retaining pieces capable of sliding along the support frame, and a seat mounted on the two seat support arms. The seat can be adjusted in height by sliding the two seat support arms upward or downward along the support frame. The seat is located at a desired height by a counterclockwise moment of couple brought about by the seat support arms and the retaining pieces at the time when the seat support arms are exerted on by the body weight of a person seated on the seat.

2 Claims, 4 Drawing Sheets

FOLDING CHAIR HAVING A SEAT ADJUSTABLE IN HEIGHT

FIELD OF THE INVENTION

The present invention relates generally to a chair, and more particularly to a folding chair having a seat which can be adjusted in height.

BACKGROUND OF THE INVENTION

The conventional folding chairs have a seat which is fixed and can not be therefore adjusted in height to suit persons of various heights. Such a drawback of the conventional folding chairs as described above has not been properly dealt with.

SUMMARY OF THE INVENTION

The primary objective of the present invention is therefore to provide a folding chair with a seat which can be adjusted in height to suit a user of the folding chair.

In keeping with the principle of the present invention, the foregoing objective of the present invention is attained by a folding chair including a support frame, two seat support arms fastened with the support frame, and a seat mounted on the two seat support arms. The seat can be adjusted in height by sliding the two seat support arms upward or downward along the main support tubes of the support frame.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
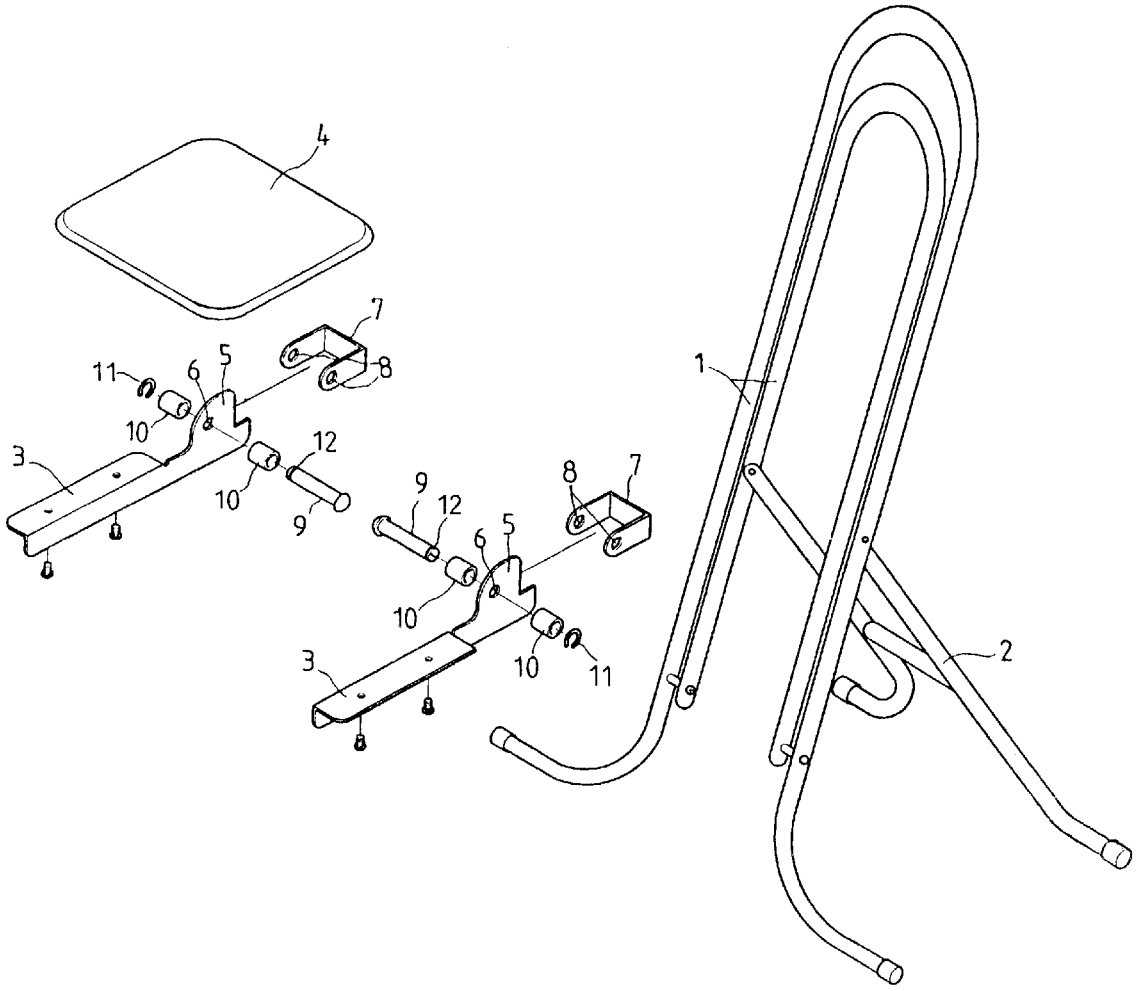
FIG. 1 shows an exploded view of the present invention.
Figure 2:
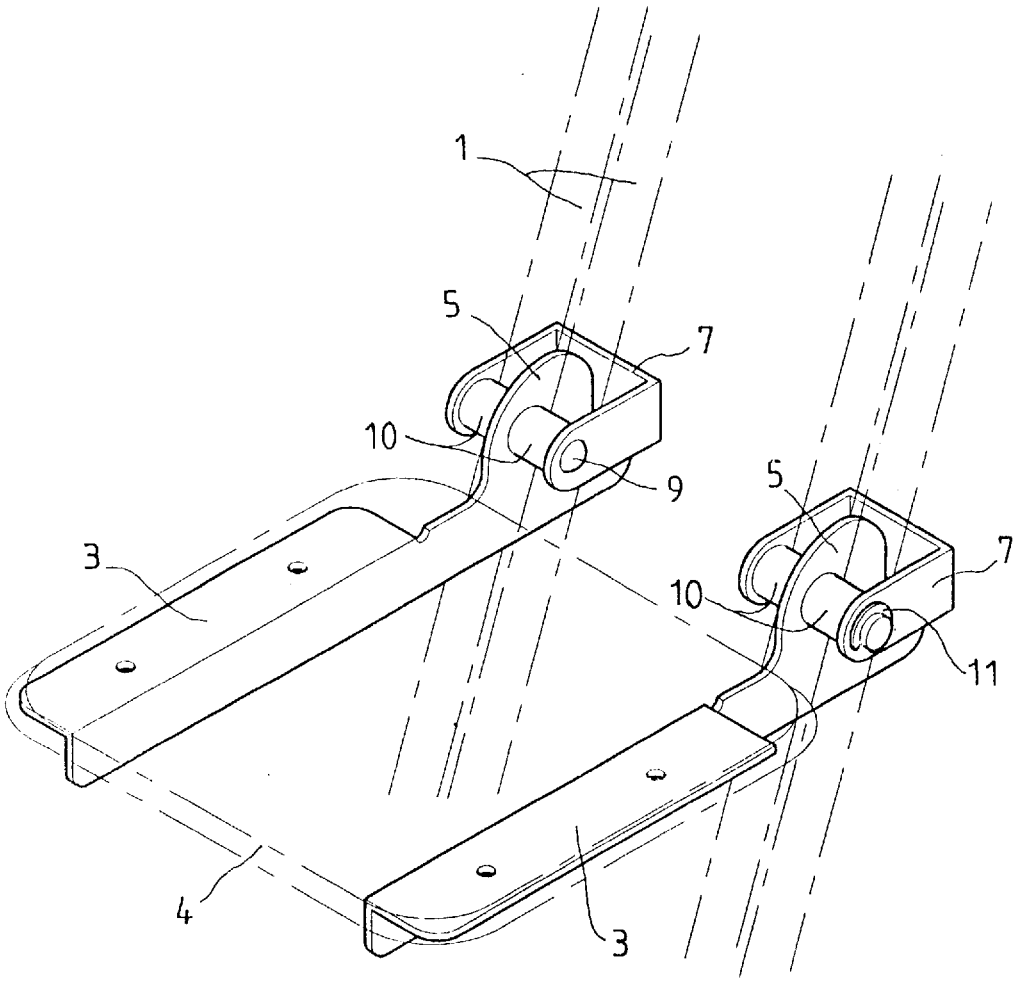
FIG. 2 shows a partial schematic view of the present invention in combination.
Figure 3:
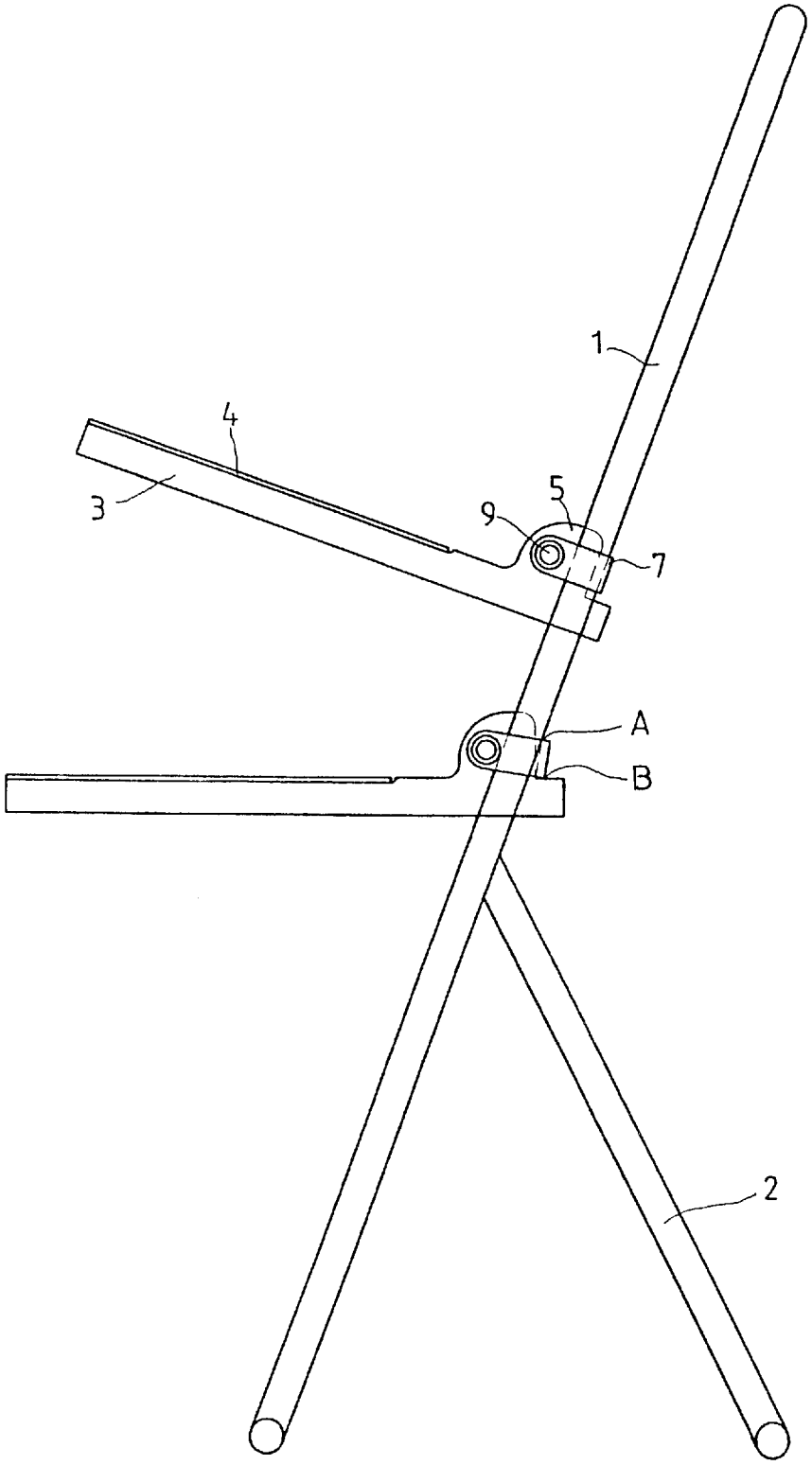
FIG. 3 shows a side schematic view of the present invention.

As shown in FIG. 1, a folding chair embodied in the present invention is composed of two inverted U-shaped main support tubes 1 which are fused together side by side, two rear support tubes 2 fastened pivotally and respectively with the main support tubes 1 such that the two rear support tubes 2 and the main support tubes 1 form a four-legged framework. The folding chair is further composed of two seat support arms 3 which are fastened respectively at one end thereof with the main support tubes 1 by a U-shaped retaining piece 7 having two through holes 8. Each seat support arm 3 has a fastening portion 5 which is provided with a through hole 6 corresponding in location to the through holes 8 of the retaining piece 7. As illustrated in FIGS. 2 and 3, the retaining piece 7 is slidably fitted over the main support tubes 1 such that the retaining piece 7 is fastened pivotally with the fastening portion 5 of the seat support arm 3 by a pivot 9 which is received in the through holes 6 and 8 in conjunction with two sleeves 10 and a C-shaped retaining ring 11 which is retained in a retaining slot 12 located at the tail end of the pivot 9. As a result, the seat support arms 3 are capable of being moved up and down along the main support tubes 1 along with the retaining piece 7. A seat 4 is mounted on the two seat support arms 3. When a person is seated on the seat 4, the seat support arms 3 are exerted on by the body weight of the person such that the sleeves 10 and the points "A" of the retaining pieces 7 are in an intimate contact with the main support tubes 1, and that the lower sides of the retaining pieces 7 are urged by the points "B" located at the ends of the seat support arms 3, thereby resulting in a counterclockwise moment of couple to enable the sleeves 10 and the retaining piece 7 to clamp securely the main support tubes 1. As a result, the seat 4 is securely located at a desired level of the main support tubes 1. The seat 4 is thus adjusted in height by lifting the seat 4 to cause the seat support arms 3 to slide upwards or downwards along the main support tube 1, as shown in FIG. 3.

Figure 4:
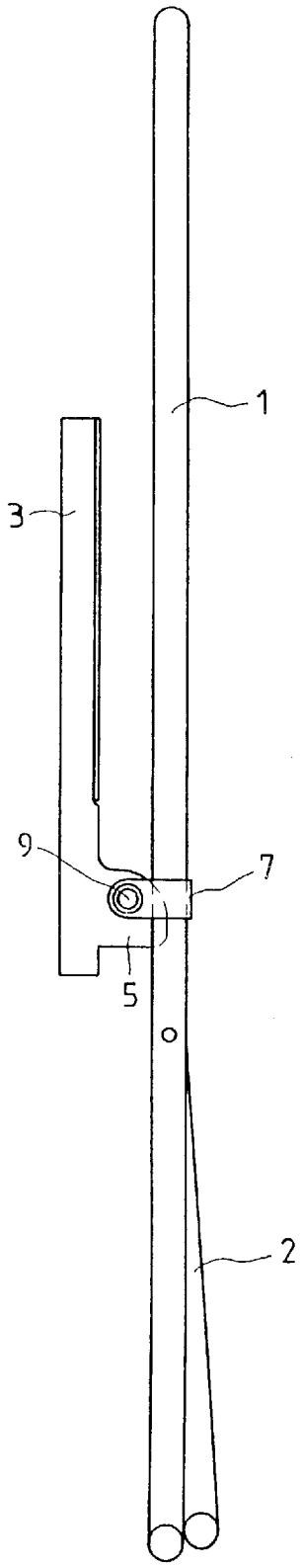
FIG. 4 shows a side schematic view of the present invention in a folded state.

As illustrated in FIG. 4, the folding chair of the present invention can be folded by lifting the seat 4 in the direction toward the main support tubes 1 such that the seat support arms 3 turn on the pivots 9 in the direction toward the main support tubes 1. In the meantime, the two rear support tubes 2 are turned so as to join with the main support tubes 1.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A folding chair comprising:

two inverted U-shaped main support tubes fused together side by side;

two rear support tubes fastened pivotally and respectively at one end thereof with said main support tubes such that said two rear support tubes and said two main support tubes form a four-legged framework;

two seat support arms fastened respectively at one end thereof with said main support tubes by a U-shaped retaining piece having two through holes, said two seat support arms having a fastening portion which is provided with a through hole corresponding in location to said through holes of said retaining piece, said retaining piece being slidably fitted over said main support tubes such that said retaining piece is fastened pivotally with said fastening portion of said seat support arm by a pivot which is received in said through holes of said retaining piece and said through hole of said fastening portion of said seat support arm, in conjunction with two sleeves and a C-shaped retaining ring which is retained in a retaining slot located at one end of said pivot; and a seat mounted on said two seat support arms such that said two seat support arms are exerted on by the body weight of a person seated on said seat, and that said sleeves and portions of said retaining pieces are in an intimate contact with said main support tubes, and further that portions of said retaining pieces are urged by ends of said two seat support arms, thereby resulting in a counterclockwise moment of couple to enable said sleeves and said retaining pieces to clamp securely said main support tubes, and still further that said seat can be adjusted in height by lifting said seat to cause said two seat support arms to slide upward or downward along said main support tubes.

2. The folding chair as defined in claim 1, wherein said seat can be lifted to move in the direction toward said main support tubes such that said seat support arms turn on said pivots in the direction toward said main support tubes; and wherein said two rear support tubes can be turned to join with said main support tubes.

* * * * *